US006174083B1

(12) United States Patent
Delefortrie et al.

(10) Patent No.: US 6,174,083 B1
(45) Date of Patent: Jan. 16, 2001

(54) FLAT SEALED SACHET

(75) Inventors: Philippe Robert Delefortrie, Ste Radegonde des Pommiers; Patricia Danièle Sueur, Verrières le Buisson, both of (FR)

(73) Assignee: SA ACP (FR)

( * ) Notice: Under 35 U.S.C. 154(b), the term of this patent shall be extended for 0 days.

(21) Appl. No.: 09/396,293

(22) Filed: Sep. 15, 1999

(30) Foreign Application Priority Data

Jun. 2, 1999 (FR) ..... 99 06938

(51) Int. Cl.[7] ..... B65D 33/00; B65D 33/36
(52) U.S. Cl. ..... 383/200; 383/906
(58) Field of Search ..... 383/200, 202, 383/203, 204, 906; 215/253; D9/305, 435

(56) References Cited

U.S. PATENT DOCUMENTS

| | | | | |
|---|---|---|---|---|
| 2,999,627 | * | 9/1961 | Reinhardt | 363/202 X |
| 3,220,610 | * | 11/1965 | Specketer | 383/202 X |
| 3,276,669 | * | 10/1966 | Vilutis | 383/204 |
| 4,696,404 | * | 9/1987 | Corella | 383/200 |
| 5,312,189 | * | 5/1994 | Aeschbach et al. | 383/906 X |
| 5,431,292 | * | 7/1995 | Culter et al. | 215/253 X |
| 5,531,358 | | 7/1996 | Corella . | |
| 5,735,401 | * | 4/1998 | Cassou et al. | 206/469 |
| 5,996,845 | * | 12/1999 | Chan | 222/107 |
| 6,062,413 | * | 5/2000 | Redmond | 220/266 |

FOREIGN PATENT DOCUMENTS

| | | | | |
|---|---|---|---|---|
| 22 00 310 | | 1/1972 | (DE) . | |
| 0 368 145 | * | 5/1990 | (EP) | 383/906 |
| WO 80/00332 | | 3/1980 | (WO) . | |

* cited by examiner

*Primary Examiner*—Jes F. Pascua
(74) *Attorney, Agent, or Firm*—Baker & Daniels

(57) ABSTRACT

A flat sealed sachet includes two sheets sealed along their edges to define a cavity therebetween. The cavity encloses one of a liquid, a pasty and a powder product. A sealing strip is defined by the sealed edges of the two sheets. A nose portion extends between the cavity and the sealing strip. A loop-shaped slit is disposed in the sealing strip and extends through the two sheets. The loop-shaped cut surrounds the nose portion and defines a horse hoof-shaped portion. The horse hoof-shaped portion is selectively separable from the sealing strip to define an orifice.

3 Claims, 1 Drawing Sheet

FLAT SEALED SACHET

BACKGROUND OF THE INVENTION

1. Field of the Invention

The present invention concerns a flat sealed sachet formed by two sheets which are sealed along their edges by a sealing strip defining a cavity receiving a liquid, pasty or powder product, the contour of said cavity being prolonged by a nose portion which intrudes into the sealing strip (non-sealed part).

2. Description of the Related Art

The flat sealed sachets of the type defined above enjoy many applications; they are primarily intended to receive a relatively small amount of a liquid, pasty or powder product which is used only in a small amount at a time. Such sachets are distributed in the form of promotional products intended to bring awareness of a production which is then sold in a different form of packaging such as a bottle but also as an individual portion which can be used as such and then the sachets are sold as single items or grouped together in another packaging.

These sachets are also packagings for food products which are used in small quantities such as for example a serving of vinaigrette or a serving of mayonnaise or mustard for certain forms of presentation of food products, for example plated meals for groups of people or fast food and so forth.

These sachets are formed in a complex multi-layer material (for example: pet/alu/pe, pet/alu/pet/pe, pet/pe, pet/paper/alu/pe), ensuring both sealing integrity of the sachet, generally opacity thereof and making it possible to seal the sachet for example by heat sealing of the peripheral edge portion of the sachet. That sealing operation is implemented with a hot stamping die of a certain width and of the shape of the contour of the sachet. In general the contour of the sachet is rectangular but it may also involve other fancy shapes, imitating a bottle or another packaging silhouette in which for example the product contained as a sample in the sachet is distributed.

The sealing strip of the sachet extending around the entire periphery of the sachet is produced in one or more operations using known processes and machines.

One of the difficulties involved in this form of packaging is that of opening the sachet, which can be very easily effected by means of a cutting tool such as a pair of scissors or a knife. Such opening means however are not always available and in particular it must be possible to open the sachet simply without a tool by tearing the sealed edge by hand.

However, as a certain pressure has to be applied to the two parts which are to be torn one from the other, that force has to be applied directly with the fingers to the cavity of the sachet or indirectly by a pulling force applied to the sachet. Compression of the volume of the cavity runs the risk at the moment of opening of the sachet of being abrupt and in particular random, causing some of the contents of the sachet to be abruptly ejected in a manner which is also unpredictable. Such an effect is not only troublesome because of the loss of product or the risk of staining that the ejected product can cause, but it also runs the risk of giving an adverse image for the packaging.

Various solutions have already been proposed for avoiding unforeseen opening in that way. One of the solutions involved consists of cutting into the sealing strip on one side of the sachet to create a rupture beginning or incipient rupture location which is enlarged at the moment of tearing it to pass through the sealing strip and then reach the location of the cavity to permit the product to be taken therefrom.

That known incipient rupture location can be disposed in line with the nose portion or spout portion which prolongs the cavity so that propagation of the tearing effect goes to a position in line with the pouring nose portion and cuts it to make it easier for the product contained in the cavity to be discharged therefrom without causing accidental sudden ejection thereof.

However, in order for that incipient rupture location to be effective for easily tearing open the sachet, having regard moreover to the high level of strength necessary for the material of the complex structure, that incipient rupture location must be of a sufficient length and the user must have a sufficient surface area on respective sides of the incipient rupture location to be able to hold the two parts of the sachet firmly. Different forms of cut have therefore been developed, starting from the incipient rupture location at the edge of the sachet and being of a greater or lesser length in order precisely to form gripping surfaces. However the length of those cuts which are no longer limited to a simple incipient rupture make the packaging more delicate and fragile since they cross a substantial part of the surface area or the width of the sealing strip. In addition even if the cut leaves a very thin connecting portion remaining (the cut not passing entirely through the whole thickness of the two layers of the complex material), that connecting portion is often torn away, the sachet part is bent back and the overall aesthetics are adversely affected.

There are also products which are not intended just for a single use but for two or three uses. This case involves profiting from the rigidity of the aluminium part of the complex material of the sachet to fold over the edge of the sachet and more or less re-close the nose portion. As the sachet is often set down flat or even if it is positioned more or less vertically, it runs the risk of slipping and adopting a flat position so that the product that it contains can ooze through the opening, even when it has been closed by being folded over, and it can give rise to stains.

SUMMARY OF THE INVENTION

The aim of the present invention is to remedy those disadvantages and for that purpose it concerns a sealed sachet of the type defined hereinbefore characterised by:

- a loop-shaped cut-out which does not open on to the edge of the sachet,
- said cut-out being provided in the sealing strip to form a horse's hoof-shaped portion around the nose portion,
- the cut-out delimiting an orifice passing through the sealing edge.

The non-opening loop-shaped cut-out requires intentional intervention on the part of the user to disengage the hoof-shaped portion delimited by the loop and grip it to tear away the part of the sachet closing the nose portion. That hoof-shaped portion does not run the risk of being torn away by accidental manipulation such as for example when sachets slide against each other or when the sachet is in rubbing contact with an object if for example the sachet is placed in a handbag without appropriate precautions being taken.

The loop-shaped cut-out also delimits a through orifice which permits the sachet to be hung up on a hook even without the hoof-shaped portion being torn away. That through orifice remains after opening of the sachet, which here again makes it possible for the sachet to be hung up on a hook, thus still retaining the product which can be put to use.

It is therefore a particularly attractive proposition to produce a sachet of rectangular shape, an upper corner of which is barred by a substantially triangular sealing surface into which the nose portion extends, the loop-shaped cut-out being produced in that triangular sealing surface.

In a particularly advantageous fashion the loop-shaped cut-out is of a rounded shape.

The possibility of easily hanging up the open sachet on a hook is a particularly attractive one from a practical point of view since, by being able to hang up the sachet on a hook, the product is prevented from running out of the open sachet. That also helps the product to move downwardly and assemble at the bottom of the sachet. Finally, the small area of opening of the nose or spout portion limits the passage of air therethrough and reduces the risk of product pollution after opening of the sachet.

From a commercial aspect, the opening disc portion can also serve as proof of purchase for different applications. Finally, when the sachet is opened and hung up, as it keeps its shape well and it is put to good use, that enhances its advertising function.

Although the rectangular sachet shape constitutes the most practical shape for packaging a product in terms of a minimum area in respect of losses by cutting for a maximum volume of the cavity, other shapes can be envisaged including polygonal shapes and more generally fancy shapes; in all cases, at the location of the nose portion, that is to say in the upper zone of the sachet, the sealing strip is provided with a cut-out which does not open to the side of the sachet and which sits astride the nose portion in order to be able to tear away the hoof-shaped portion and free the content of the sachet by simply disengaging the hoof-shaped portion which is thus formed by the cut-out configuration.

BRIEF DESCRIPTION OF THE DRAWINGS

The present invention will be described in greater detail hereinafter by means of the accompanying drawings in which.

DETAILED DESCRIPTION OF THE INVENTION

Figure 1:
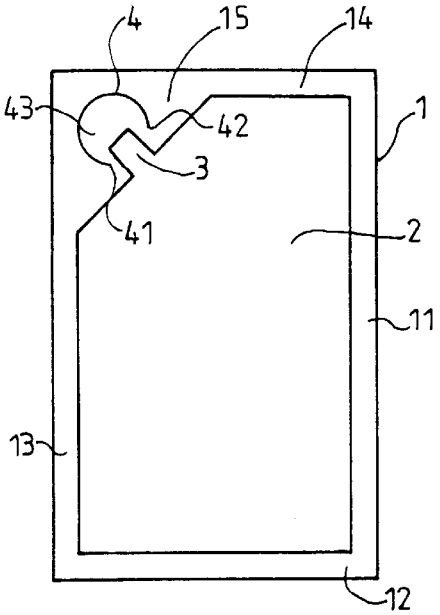
FIG. 1 is a diagrammatic view of a sachet according to the invention.

Referring to FIG. 1 the invention concerns a flat sealed sachet which in this example is rectangular in shape. It is composed of two sheets of a complex material of the type referred to hereinbefore having functions in respect of fluid-tight integrity, sealing by thermal welding, strength and covering by a coating which is for example metallised, making the complex material opaque. The sachet 1 has its sides 11, 12, 13, 14 sealed over a strip of a certain width to delimit in the interior of that contour a cavity 2 for receiving a product which is generally liquid, pasty or in powder form. The volume of product represents one or more quantities or servings which can be used in one go or a number of times.

The contour delimiting the cavity 2 is provided with a part 3 in the form of a nose portion constituting a spout portion for distribution of the product contained in the cavity 2. The nose portion 3 penetrates into the sealing strip at the junction of the sides 13, 14, which are here formed by a sealing zone 15 of triangular shape. The sealing zone 15 comprises a loop-shaped cut or cut-out or slit which does not open on to the sides of the sachet 1 but which has at its two ends 41, 42 in each case an incipient rupture portion disposed close to the nose portion 3.

This cut-out 4 can be disengaged without torn away from the remaining surface of the sealing zone 15, an orifice passing through the sealing and making it possible for example for the sachet 1 to be hung up on a hook.

To take the content from the cavity, it is only necessary to disengage the hoof-shaped portion 43 defined by the cut-out 4 to have a gripping surface which can then be torn away or pulled to cause the incipient rupture locations 41, 42 to progress and to tear open the nose portion 3 to free the contents of the cavity.

Figure 3:
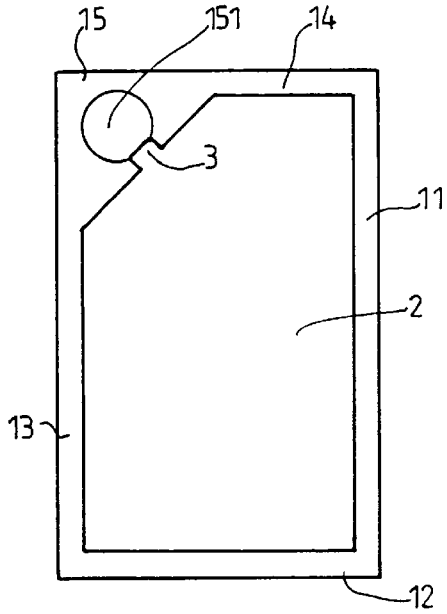
FIG. 3 is a similar view to that shown in FIG. 1 of a sachet, the hoof-shaped portion of which has been torn away.

The sachet 1 of which the hoof-shaped portion 43 has been torn away to open the orifice 151 and the nose portion 3 is shown in FIG. 3. In FIGS. 1 and 3 the contour of the cavity 2 and the nose portion 3 is shown in solid lines as a simple drawing convention.

Figure 2A:
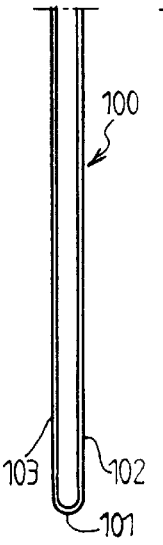
FIG. 2A is a diagrammatic view in cross-section of a strip of material which is folded to form the two faces of a sachet.

The sachet 1 is for example produced from a strip 100 of complex material, which is folded continuously along its central line 101 to form the two faces 102, 103 which will be sealed to each other (FIG. 2A).

Figure 2B:
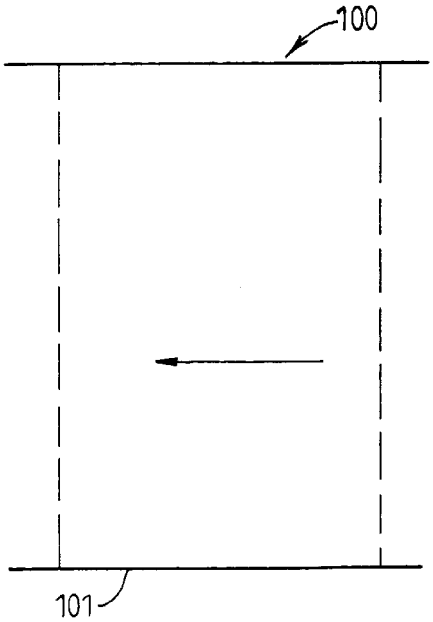
FIG. 2B is a diagrammatic view of a complex before application of the sealing tool.

FIG. 2B is a front view of the folded strip 100 which thus passes in the machine (not shown) in the direction indicated by the arrow, the two faces of the sachet to be produced therefrom being delimited by two vertical dashed lines.

Figure 2C:
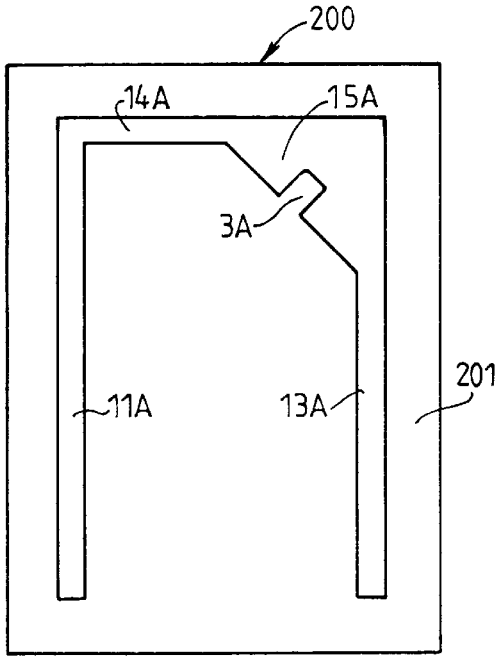
FIG. 2C is a plan view of a sealing tool for producing a sealing action for a sachet such as that shown in FIG. 1.

FIG. 2C shows a sealing stamp or die 200 which is shown in the position in which it is turned over with respect to its position of being applied against the strip 100 to form the sealing stamp, then producing the strips 11, 13, 14, 15; the lower strip 12 is produced on the fold at the location of the line 101 by a different tool (not shown).

The rectangular shape of the sachet 1 and the corresponding shape of the sealing means 11–15 which matches the contour of the sachet is produced by a tool as shown in FIG. 2C. This involves a support plate 201 carrying a raised portion constituting the sealing tool member. The raised portion is made up in this case of two limbs 11A and 13A which are vertical (in the direction of the Figure) and a transverse limb 14A as well as a triangular surface 15A in the top right corner.

The reserve 3A makes it possible to not seal the surface which will form the nose portion of the sachet. After application of the sealing stamp or die 200, the cut-out 4 is produced with a blade of suitable shape. That blade is not shown.

At the discharge from the production line the sachets are cut from the strip along the broken lines in FIG. 2B.

There are different known machines for producing sachets. It is sufficient to convert such machines by equipping them with a sealing stamp or die of suitable shape and a cutting blade to produce the sachets according to the present invention.

The sealing tool produces the sealing surface 11, 12, 13, 14, 15 of the sachet shown in FIG. 1 by simply applying pressure in the hot condition against the two faces of the complex material which are caused to bear against each other.

The third sealing edge 12 is produced in the usual manner with a separate sealing tool (not shown). This may also involve two rollers between which complex material 100 passes in the form of strips.

The rounded shape of the loop configuration 4 is particularly advantageous for permitting so-to-speak the nose portion 3 to be capped while creating two incipient rupture locations at each end.

The cut-out 4 can allow a slight thin web portion of material to remain to retain the hoof-shaped portion 43 to remain in the plane of the sealed portion 15, to avoid internal stresses acting and involving the risk for example of bending or curving the portion 43 with respect to the remaining portion 15.

What is claimed is:

1. A flat sealed sachet comprising:

two sheets sealed along their edges and defining a cavity therebetween for receiving one of a liquid, a pasty and a powder product, said sealed edges defining a sealing strip, said cavity including a nose portion which extends into said sealing strip;

a loop-shaped slit disposed in said sealing strip adjacent said nose portion and surrounding said nose portion and defining a horse hoof-shaped portion, said horse hoof-shaped portion selectively separable from said sealing strip to define an orifice.

2. A flat sealed sachet according to claim 1 wherein said sachet is rectangular in shape and a corner, said sachet is occupied by a sealed triangular zone, said nose portion extending into said sealed triangular zone.

3. A flat sealed sachet according to claim 2 wherein the loop-shaped slit is arcuate in shape and has two ends disposed slightly to respective opposite sides of the nose portion.

* * * * *